United States Patent [19]

Wiley

[11] Patent Number: 4,726,501

[45] Date of Patent: Feb. 23, 1988

[54] EDGE STEERAGE APPARATUS

[75] Inventor: Thomas W. Wiley, Asheville, N.C.

[73] Assignee: Tex-nology Systems, Inc., Fairview, N.C.

[21] Appl. No.: 808,005

[22] Filed: Dec. 12, 1985

[51] Int. Cl.[4] ..... B65G 47/24; B65H 7/02; B65H 9/18; D06C 3/06

[52] U.S. Cl. ..... 226/15; 26/77; 198/394; 226/20; 226/21; 226/170; 271/227; 271/251

[58] Field of Search ..... 271/227, 251; 26/77, 26/51.5; 226/15, 17, 18, 20, 170, 22, 23, 174, 21; 198/394, 456, 434

[56] References Cited

U.S. PATENT DOCUMENTS

| | | | |
|---|---|---|---|
| 1,919,291 | 7/1933 | Coolidge . | |
| 2,096,087 | 10/1937 | Coolidge | 26/67 |
| 2,118,375 | 5/1938 | Dungler | 26/67 |
| 2,308,985 | 1/1943 | Krieger | 226/15 |
| 2,422,369 | 6/1947 | Robertson | 26/66 |
| 2,511,194 | 6/1950 | Blaber | 198/202 |
| 2,718,156 | 9/1955 | Wright | 74/241 |
| 2,722,415 | 11/1955 | Wood, Jr. | 226/23 X |
| 2,801,102 | 7/1957 | Walter et al. | 271/2.6 |
| 2,835,490 | 5/1958 | Dungler | 271/2.6 |
| 2,853,295 | 9/1958 | Sabee | 226/23 |
| 3,147,898 | 9/1964 | Huck | 226/17 |
| 3,373,288 | 3/1968 | Otepka et al. | 226/20 X |
| 3,750,920 | 8/1973 | Fountain et al. | 226/23 |
| 3,750,924 | 8/1973 | Pepper | 226/174 |
| 3,850,121 | 11/1974 | Speer | 112/147 X |
| 3,894,565 | 7/1975 | Pechstein | 139/296 |
| 4,066,025 | 1/1978 | Speer | 112/147 X |
| 4,244,461 | 1/1981 | Fischer et al. | 198/456 |

*Primary Examiner*—Stuart S. Levy
*Assistant Examiner*—Lynn M. Sohacki
*Attorney, Agent, or Firm*—Luedeka, Hodges & Neely

[57] ABSTRACT

An edge steerage apparatus for steering an edge of a moving web to correct for misalignment of the edge in the direction of travel. The apparatus includes one or more edge steerage units, each unit having a pair of pivotally supported, spaced-apart wheels adjacent to the edge of the web for contacting the moving web. For each of the wheels of the steerage unit, a spherical ball is provided which rotates freely omni-directionally so that the web is engaged between the wheels and the spherical ball. The two wheels of a steerage unit have a slight toe-out so that the web between the wheels is maintained in a taut condition. The position of the edge is monitored in relation to a fixed position and a steerage drive orients the wheels to introduce lateral movement in the cloth between the wheels and at the edge to steer the edge toward the fixed position.

20 Claims, 5 Drawing Figures

EDGE STEERAGE APPARATUS

The present invention relates to the handling of moving webs and more particularly relates to an apparatus for steering an edge of a moving web to correct for misalignment of the edge in the direction of travel.

Many apparatus are known for the alignment of moving webs such as continuous belts, cloth, paper, and other such materials. Typically, known alignment systems employtwo pairs of guide rolls at opposite sides of the web which act to spread and guide the web. Such apparatus pull the entire web from side to side to align the entire web typically with respect to its center line or with respect to one or both of its edges.

For many manufacturing operations involving webs such as woven and nonwoven fabrics, scrim, various types of mesh and the like, it is necessary or desirable to accurately direct or align one or both edges of the web as the web is being fed into equipment for performing an operation. For example, in the automated formation of hems during the manufacture of various textile flat goods, it is necessary for the cut edges of the cloth to be steered properly into hemming equipment. Known equipment for guiding the entire web is incapable of efficiently steering and edge of the cloth to compensate for misalignment and distortion of the edge due to any irregular tension in the cloth or for minor variations in width of the cloth. In addition, known equipment cannot efficiently steer both edges of a moving web independently as is desired for automated hemming and other such operations to be performed on both edges simultaneously.

Most web guiding devices are intended for use with continuous web materials where the web is manually loaded into the guiding device before start up. Such devices are unsuitable for the handling of discrete moving sheets of a web material, such as cut cloth being carried on a conveyor. Known guiding devices cannot effectively engage a discrete moving sheet and then properly steer its edges.

It is accordingly an object of the present invention to provide an apparatus for steering an edge of a moving web to correct for misalignment in the direction of travel. It is a further object of the present invention to provide an apparatus for steering both edges of a moving web independently. It is another object of the present invention to provide an apparatus for the steering of an edge a web which is suitable for engaging and steering edges of discrete sheets of a moving web.

In accordance with one form of the present invention, edge steerage apparatus generally includes one or more edge-steerage units for steering an edge of a moving web each including a pair of spaced-apart, rotatable wheels, one of which is adjacent to said edge, for contacting the moving web at two contact points along a line generally perpendicular to the direction of web movement. The wheels are supported for pivotal movement to change the orientation of rotation of said wheels while generally maintaining the same contact points. In addition, the wheels are maintained with a slight toe-out in the direction of web movement. Further included is web contact means opposing the wheels at the contact points and for contacting the web and providing omni-directional planar movement of the web. An edge monitoring means is provided for monitoring the lateral position of the edge as the web passes a fixed position. A steering drive, responsive to the edge monitoring means, orients the wheels to introduce lateral movement of the moving web between the wheels and at the edge to steer the edge toward the fixed position and correct for misalignment of the edge in the direction of travel.

In accordance with a preferred form of the present invention, the wheels are power driven so that a wheel contact surface which contacts the web moves faster relative to the moving web to compensate for the longer paths along the web which the wheels define when the wheels are not aligned with the direction of web movement.

In accordance with another preferred form of the present invention, the web contact means is a spherical ball supported for free omni-directional rotation.

In accordance with various forms the present invention, single edge steerage units for steering a single edge, right and left steerage units for steering both edges, and tandem units, i.e., two edge steerage units for steering a single edge, are provided.

In accordance with another aspect of the present invention, there is provided a drive system for apparatus for guiding an edge with respect to a fixed position including a reversible synchronous motor with reduction gearing, crank arm and pitman connected to the apparatus and monitoring means for actuating the motor guide the edge inwardly when the edge is outboard of the fixed position and actuating the motor to guide the edge outwardly when the edge is inboard of the fixed position.

The various forms of the edge steerage apparatus according to the present invention are capable of steering one or both edges of a moving web to correct for misalignment in the direction of travel and are capable of engaging discrete sheets of a moving web and steering the edges. Furthermore, forms of the present invention are particularly well suited for the steering of the edges of deformable webs, i.e., webs which are limp, extensible, or both such as woven and nonwoven fabrics, scrim, mesh, and the like.

The objects and advantages of the present invention may best be understood by reference to the following detailed description of a preferred embodiment and accompanying drawings in which.

Figure 1:
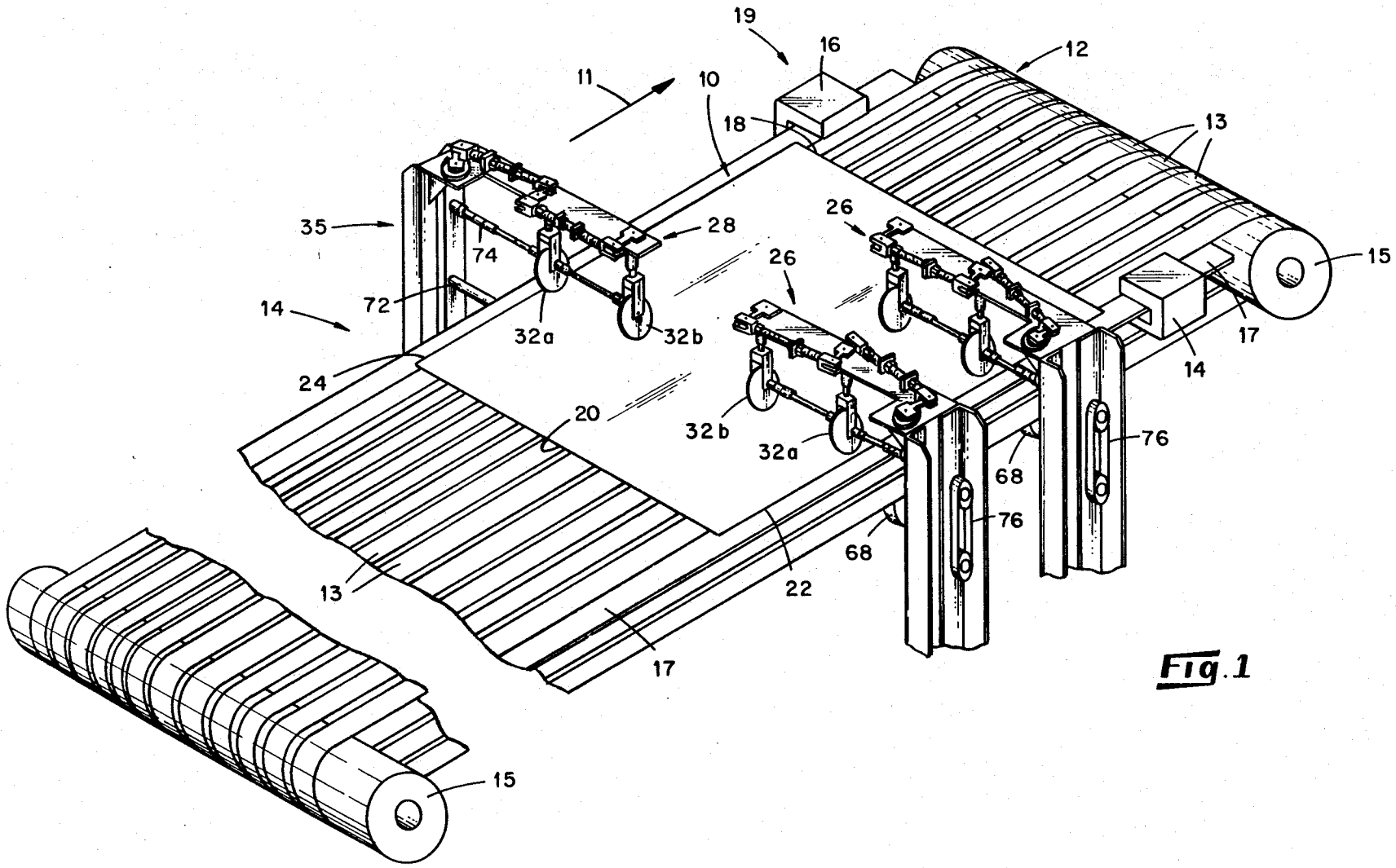
FIG. 1 is a somewhat diagrammatical perspective view of equipment for hemming bed sheets employing embodiments of edge steerage apparatus according to the present invention.

Referring now to the drawings in which like reference characters designate like or corresponding parts throughout the several views, there is shown diagrammatically in FIG. 1 equipment and a process for the simultaneous formation of hems on both cut edges of a sheet of cloth 10 as in the automated manufacture of bed sheets. The equipment and process are shown for the purposes of illustrating embodiments of the present invention and there is no intent to limit the invention to the application illustrated.

Referring to FIG. 1, the sheet of cloth 10 is carried on conveyor 12 towards a hem forming station 14 in the direction of arrow 11. The conveyor 12 includes a plurality of endless belts 13 carried on driven rollers 15. The belts 13 ride on table 17 and thus a generally continuous support surface for the sheet 10 is provided as the sheet 10 is carried toward the hem forming station 19.

The hem forming station 19 includes a right and left hem forming units 14 and 16 respectively, shown diagrammatically and which are intended to represent hem forming equipment as is described, for example, in either U.S. Pat. No. 3,850,121 or 4,066,025. The sheet 10 on the conveyor as shown has selvage at the leading edge 18 and the trailing edge 20. Hems are formed on the cut edges, i.e., the right and left side edges 22 and 24, respectively, as the cut edges are fed into the right and left hem forming units 14 and 16.

Referring still to FIG. 1, embodiments of the edge steerage apparatus according to the present invention are employed to steer the cut edges of the sheet 10 to correct for misalignment with the direction of travel as the sheet 10 is conveyed into the hem forming units 14 and 16. For the purposes of illustration, edge steerage apparatus includes two right hand edge steerage units 26 in tandem for steering the right side edge 22 into the right hem forming unit 14. The left side edge 24 is steered by a single left hand unit 28 into the left hem forming unit 16. It will be understood that the edge steerage apparatus illustrated is intended for illustrating various configurations of the apparatus according to the present invention and that a single right or left hand unit, tandem units or both right hand left hand units and other such combinations are with the scope of the invention.

As depicted in FIG. 1, edge steerage units 26 and 28 each include a pair of pivotally supported spaced-apart wheels 32*a* and 32*b*. Wheel 32*a* is adjacent to the right side edge 22 of the sheet 10 for a right hand unit 26 and, for a left hand unit 28, wheel 32*a* is adjacent to the left side edge 24 of the sheet 10. While the wheel 32*a* is adjacent to the edges, it is necessary for it to be sufficiently far apart to permit steering as will be described. As is apparent, this distance is also limited by the weight and stiffness of the web. It will also be understood that the left hand unit 28 depicted is a mirror image of a right hand unit 26 and that the following detailed description of the right hand unit 26 also corresponds generally with a left hand unit 28. The wheels 32*a* and 32*b* contact points on the sheet 10 along a line generally perpendicular to the direction of web movement indicated by arrow 11. In the embodiments depicted, the wheels 32*a* and 32*b* are supported by support structure 35 and are power driven as will be described in more detail hereinafter.

Figure 2:
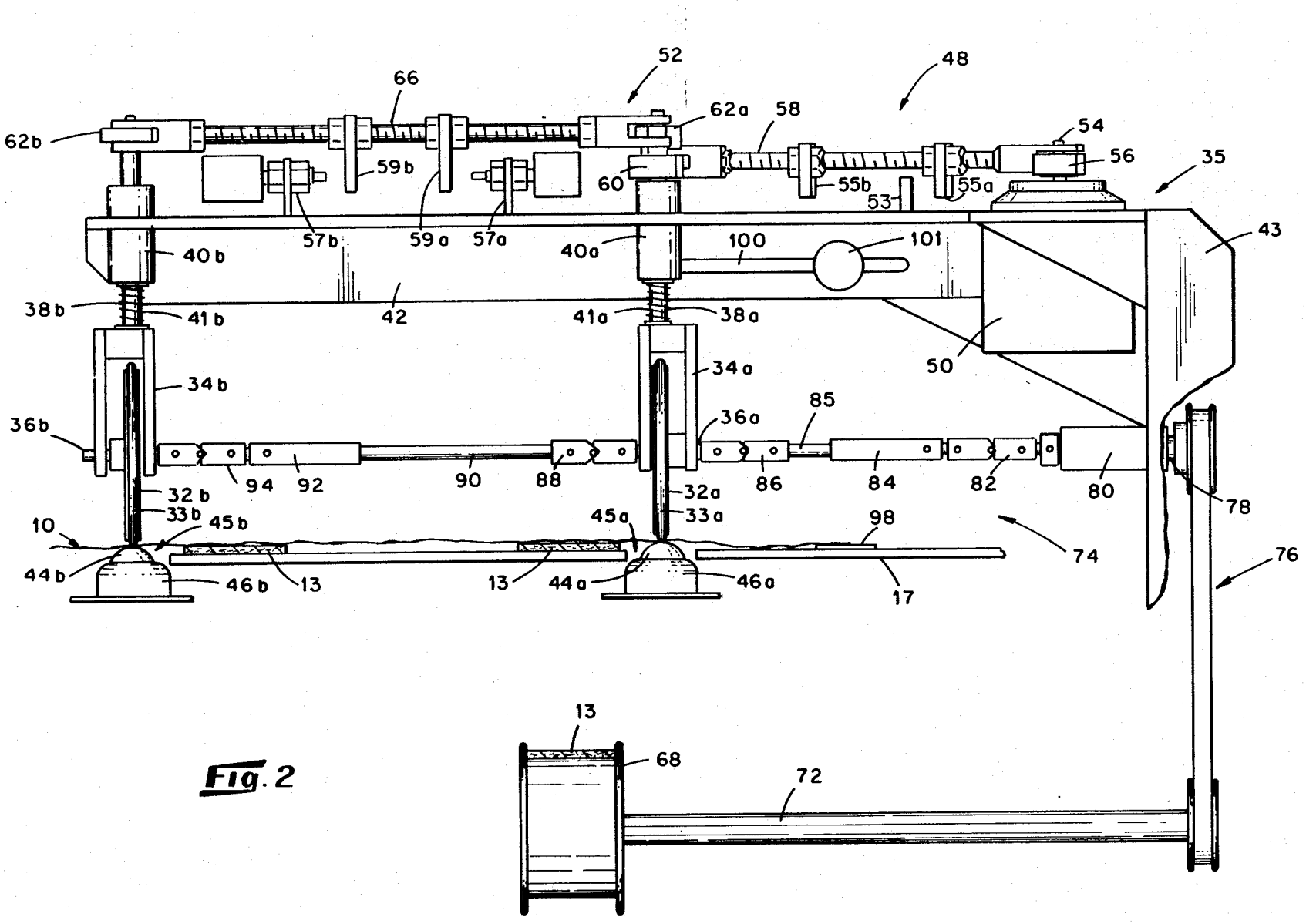
FIG. 2 is an elevational view of one form of an edge steerage unit according to one form of the present invention.

Referring now to FIG. 2, a preferred embodiment of a right hand unit 26 is shown in detail. As shown, the wheels 32*a* and 32*b* are preferably provided with resilient rolling surface having a rounded, preferably semicircular, cross-section. This is suitably accomplished as shown by providing wheels having a rim for receiving a resilient rings such as a rubber O-rings 33*a* and 33*b*.

Each of the wheels 32*a* and 32*b* is supported for pivotal movement by the support structure 35 to enable change in the orientation of rotation of the wheels while generally maintaining the same contact points. Support structure 35 as depicted in FIG. 2 includes wheel support yokes 34i a and 34*b*, respectively, and axles 36*a* and 36*b*, respectively, suitably journaled in the yokes which support the wheels 32*a* and 32*b*, respectively, for rotation in a generally vertical orientation. Wheel support yokes 34*a* and 34*b* are attached to wheel support shafts 38*a* and 38*b* which are rotatably mounted vertically to provide pivotal motion of the wheel support yokes 34*a* and 34*b* and wheels 32*a* and 32*b*. This is preferably accomplished by supporting the wheel support shafts 38*a* and 38*b*, respectively, in wheel support sleeves, 40*a* and 40*b*, respectively, which are in turn supported by an arm 42 which extends above the conveyor 12 in a direction generally perpendicular to the direction of movement of the sheet 10. As shown, it is most preferable that the wheel support shafts 38*a* and 38*b* to be vertically slidable in support sleeves 40*a* and 40*b* and springs 41*a* and 41*b* are provided to urge the wheels 32*a* and 32*b* towards the table 17 of the conveyor 12. Arm 42 is supported by an upright 43 which is attached, for example, to the frame (not shown) of the conveyor 12.

Referring still to FIG. 2, the sheet 10 is contacted on its underside at points corresponding to the contact points of the wheels 32*a* and 32*b* so as to enable omnidirectional, generally planar movement of the sheet 10. Preferably, this is accomplished by a spherical balls 44*a* and 44*b*, respectively, which extend upwardly through openings 45*a* and 45*b*, respectively, in the table 17. Spherical balls 44*a* and 44*b* are supported for free omnidirectional rotation in ball support receptacles 46*a* and 46*b*, respectively, beneath wheels 32*a* and 32*b*, respectively. The spherical balls 44*a* and 44*b* and receptacles 46*a* and 46*b* are suitably provided by ball conveyor bearings as illustrated. The ball support receptacles 46*a* and 46*b* of the bearings are supported beneath the conveyor surface by any suitable means such a being attached to the conveyor frame (not shown) and are positioned so that the uppermost point of the spherical balls 44*a* and 44*b*, respectively, extend a short distance above the table 17 to tangentially contact the lowermost points of the wheels 32*a* and 32*b*. In the preferred embodiment depicted, the wheels 32*a* and 32*b*, respectively are yieldably urged toward the spherical balls 44*a* and 44*b* by springs 41*a* and 41*b* so that the sheet is engaged between the wheels and spherical balls as shown in FIG. 2. Since the support shafts are slidably mounted the wheels are able upwardly to compensate for variations in thickness of a sheet 10 and to accommodate sheets of differing thickness.

Figure 3:
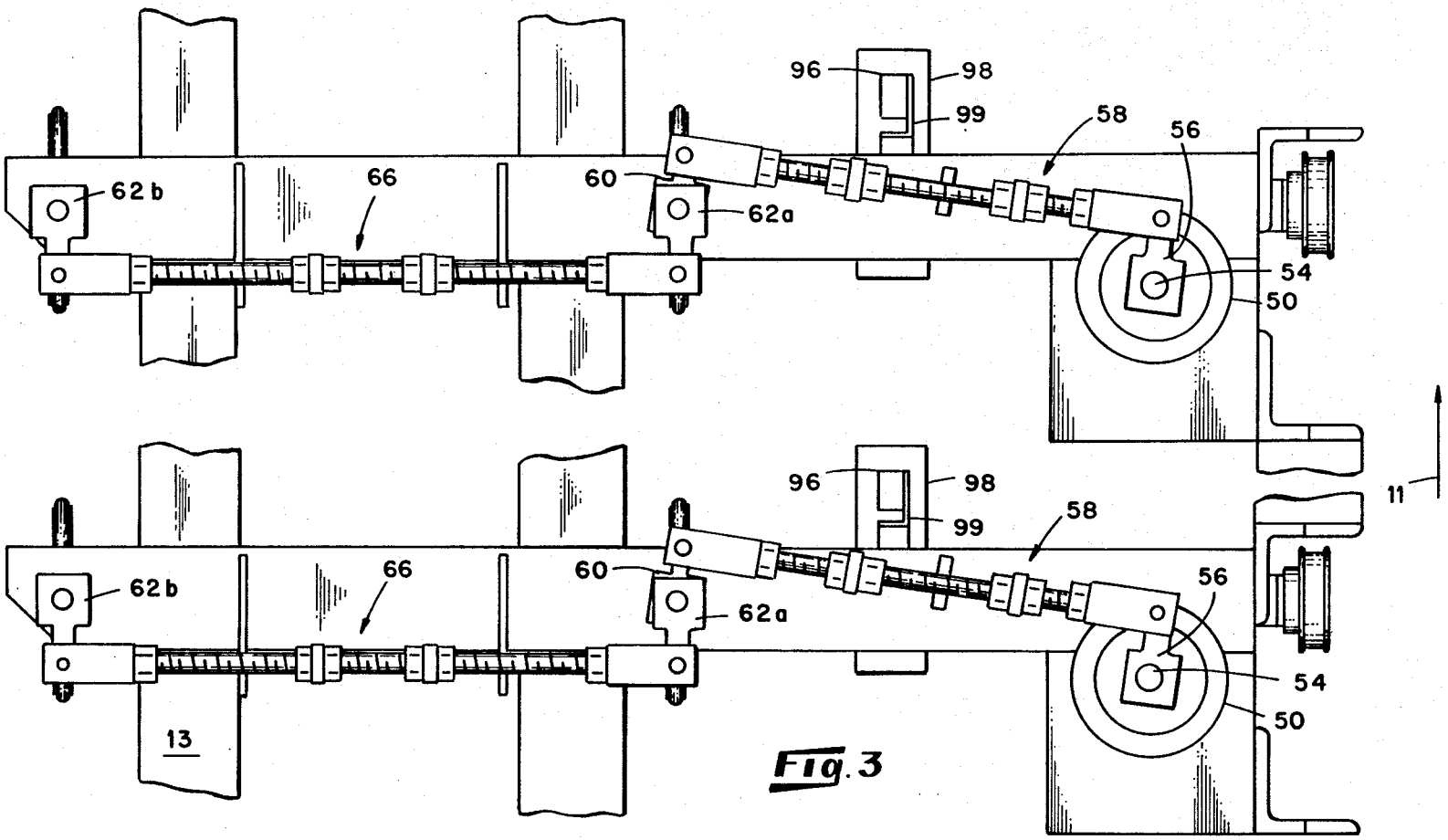
FIG. 3 is a plan view of tandem edge steerage units according to one form of the present invention.

Referring now to FIGS. 2 and 3, the wheels 32*a* and 32*b* are maintained in a configuration with a slight toe-out in relation to the direction of travel. As depicted in FIG. 3, the portion of the wheels 32*a* and 32*b* extending forwardly from the axle in the direction of travel (towards the top of FIG. 3) are thus slightly farther apart than the portion of the wheels extending rearwardly (toward the bottom of FIG. 3). The amount of toe-out is varied for the material being handled and should be sufficient to the material in a slightly taut condition between the wheels 32*a* and 32*b* as the material moves through a steerage unit. For example, with cloth for bed sheets, 1/16 inch (measured at the leading edge of the wheels) is sufficient toe-out.

Steerage drive 48 is provided to maintain the toe-out and to pivot the wheels and includes a reversible motor with gear reduction 50 and steering linkage 52 as will be described in more detail hereinafter. Preferably, the reversible motor with reduction gearing 50 is mounted on the upright 43 adjacent to the arm 42 with its output shaft 54 extending upwardly and being generally parallel to wheel support shafts 38*a* and 38*b*. A suitable reversible motor with gearing 50 is a permanent magnet inductor motor operated as an AC synchronous constant speed motor such as the motor sold under the trademark "SLO-SYN", No. SS50-P2 by The Superior Electric Co., Bristol, Conn. This motor has a built in planetary speed reducer which reduces the 72 rpm motor to 3.32 rpm.

A crank arm 56 is connected to the motor output shaft 54 and extends away from the motor shaft 54 generally in the direction of the movement of the sheet 10. Attached pivotally to the crank arm 56 is a pitman 58 which extends toward wheel 32*a*. The pitman 58 is pivotally attached to a steering control arm 60 which is connected to wheel support shaft 38*a*. Also attached to wheel support shaft 38*a* is a track arm 62*a* which extends from the wheel support shaft 38*a* generally opposite the direction of movement of the sheet 10. A similar track arm 62*b* is connected to wheel support shaft 38*b*. Pivotally connected between track arms 62*a* and 62*b* is track rod 66.

As shown in FIGS. 2 and 3, pitman 58 and track rod 66 are suitably provided by threaded rod with clevis ends which facilitate adjustment of the linkage. In addition, an adjustable mechanical stop is provided by means of fixed tab 53 attached to and extending upwardly from arm 42. Right and left stop tabs 55*a* and 55*b*, respectively, are adjustably attached such as by nuts to pitman 58 and extend downwardly and contact the tab 53 and mechanically prevent oversteering. As will be described in more detail hereinafter, inboard and outboard limit switches, 57*a* and 57*b*, are mounted on arm 42 above and between the wheels 32*a* and 32*b* and are actuated by inboard and outboard adjustable contacts 59*a* and 59*b*, respectively, which are adjustably attached to and extend downwardly from the track rod 66.

In the preferred form of the invention as depicted in FIGS. 1, 2 and 3, the wheels 32*a* and 32*b* are power driven to rotate with the movement of the sheet 10. Preferably, for equipment of the type illustrated with a conveyor with endless belts 13, the wheels 32*a* and 32*b* are driven by a take-off drum 68 driven by one of the conveyor belts 13. As is most easily seen in FIG. 2, the take-off drum 68 is supported on a take-off shaft 72 suitable journaled and supported by uprights 43 so that the take-off drum 68 contacts the underside of the returning endless belt 13. Preferably the wheels 32*a* and 32*b* are driven at a speed which is slightly faster than the belts 13 by employing a take-off drum 68 with a diameter which is slightly smaller than the diameter of the wheels 32*a* and 32*b*. This is desirable in order to compensate for longer path along the sheet defined by the wheels during steering when the wheels 32*a* and 32*b* are not directly aligned with the overall direction of travel of the sheet 10.

Take-off shaft 72 is connected to a drive shaft 74 connected to the wheels 32*a* and 32*b* by belt and pulleys 76 of equal size as shown in FIG. 2 so that the speed of the drive shaft 74 is the same as the take-off shaft 72.

Figure 4:
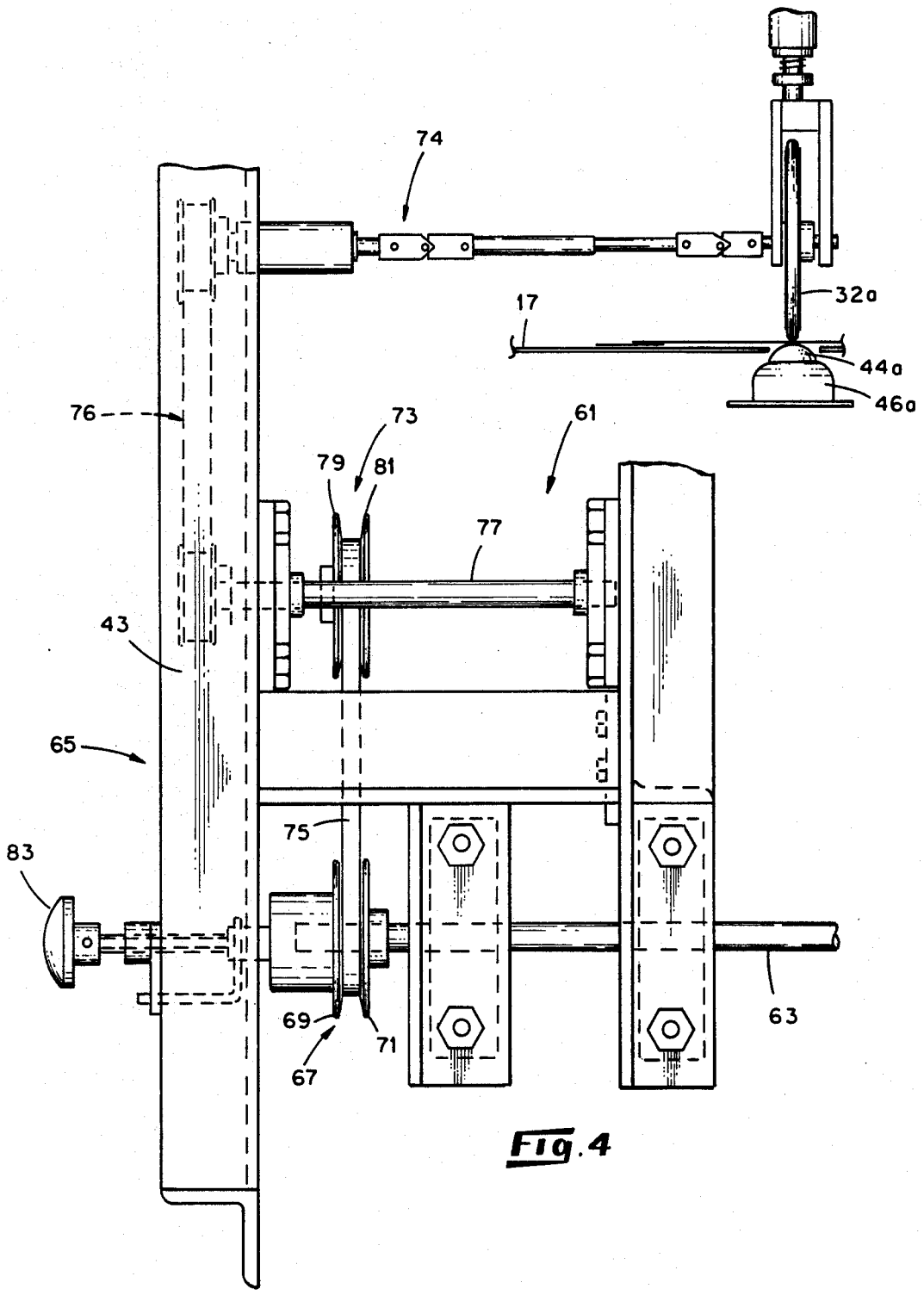
FIG. 4 is an elevational view of an alternate power take-off for edge steerage apparatus according to the present invention.

FIG. 4 illustrates an alternate power take-off 61 for driving the wheels 32*a* and 32*b* at a proper speed in relation to the movement of the sheet 10 without the use of a take-off drum. Power drive 61 includes shaft 63 which is driven by, for example, a motor (not shown) such as for the driving the conveyor 12. In order to adjust the speed of the wheels 32*a* and 32*b*, speed control 65 is employed to adjust the speed of the belt and pulleys 76. Speed control 65 includes a V-belt drive pulley 67 with an adjustable sheave 69 to adjust the distance between the adjustable sheave 69 and a fixed sheave 71. A driven pulley 73 is driven by the adjustable pulley 67 by V-belt 75 and is supported on shaft 77 which is connected to pulleys and belt 76 as employed with the take-off drum system. Driven pulley 73 includes a fixed sheave 79 and a spring-loaded sheave 81. To adjust the speed, an adjustment control knob 83 is adjusted to change the spacing of the adjustable sheave 69 and the fixed sheave 71 which changes the distance of the V-belt 75 from the shaft 63 as it rides in the pulley 67. Driven pulley 73 with spring-loaded sheave 81 correspondingly adjusts to maintain belt tension.

Referring again to FIG. 2, drive shaft 74 provides power for the wheels 32*a* and 32*b* and permits pivotal movement as the wheels are driven. Preferably, drive shaft 74 includes a fixed shaft section 78 adjacent the belt and pulleys 76 which is journaled for rotation in support sleeve 80 mounted on upright 43. Between the fixed shaft section 78 and the wheel 32*a*, is a first universal joint 82 adjacent the fixed shaft section 78 which is coupled to slip coupling 84 for sliding on a shaft section 85. Shaft section 85 is connected to a second universal joint 86 which in turn is connected to axle 36*a* for the wheel. Shaft section 85, first and second universal joints 82 and 86, and slip coupling 84 permit wheel 36*a* to be pivoted while being driven. Similarly, a third universal joint 88 is connected to the axle 36*a* and to a drive shaft section 90. Drive shaft section 90 is slidably connected to slip coupling 92 which in turn is connected to fourth universal joint 94. Fourth universal joint 94 is connected to axle 36*b* which transmits rotation to the wheel 32*b*.

Each edge steerage unit depicted in FIG. 1 includes a edge monitoring system with control circuitry for monitoring the position of the edge and controlling the steering of the wheels to steer the edge as desired. As shown in FIG. 3, the edge monitoring system preferably includes electric eye 96 and retro-reflective tape 98 which monitors the position of the edge with respect to a fixed position. As illustrated in FIGS. 2 and 3, electric eye 96 is suitably supported on the arm 42 preferably with bracket 99 which is adjustably attached in adjustment slot 100 so as to be laterally adjustable by loosening adjustment nut 101 and sliding along the slot 100 to the desired position for the edge of the sheet 10. Retro-reflective tape 98 is suitably provided beneath the eye as by applying it to the table 17. Preferably as shown, the electric eye 96 and retro-reflective tape 98 are just downstream of a steerage unit to monitor the position of the edge as it passes a steerage unit. In the preferred embodiment, the electric eye 96 preferably is a miniature retro-reflective type photoelectric sensor with built in amplifier such as the McGill "PhotoEye", No. 1720-4501, sold by the McGill Manufacturing Co., Inc. of Valparaiso, Ind.

Figure 5:
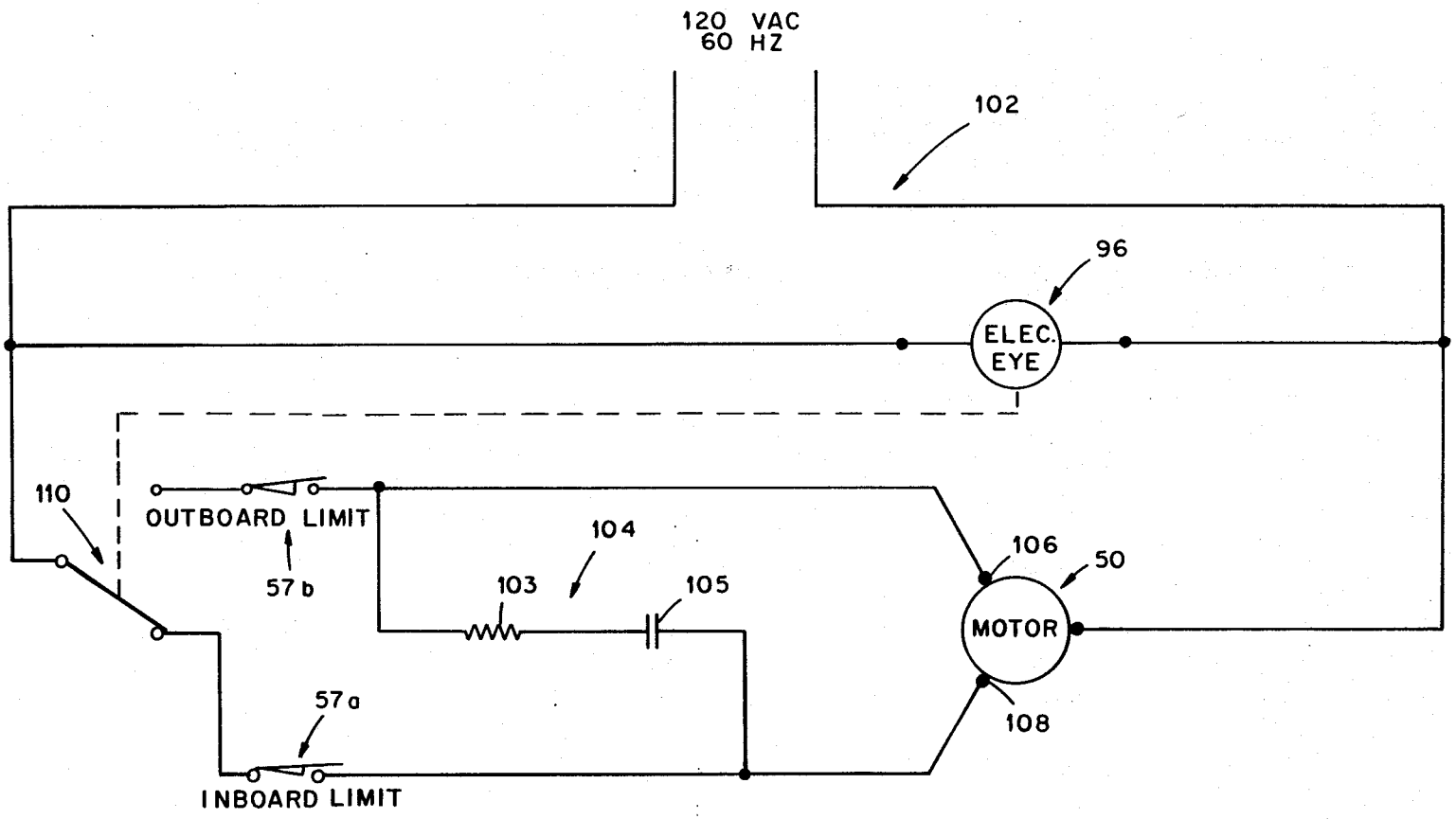
FIG. 5 is a schematic diagram of preferred control circuitry employed in an embodiment of edge steerage apparatus according to the present invention.

Using the type of electric eye described above, and the motor and reduction gearing 50 previously described, i.e. "Slo-Syn" motor, FIG. 5 illustrates a preferred control circuit 102 for a right hand unit 26. The circuit 102 is supplied with 120 volt alternating current at 60 cycles per second and includes a phase shifting network 104 for operating the Slo-Syn motor from a single phase source. The phase shifting network employed includes a 400 ohm resistor 103 and a 2.5 mf capacitor 105 in series across a clockwise terminal 106 and a counterclockwise terminal 108 of the motor 50. A single pole, double throw relay 110 (built into the McGill "Photo Eye") controls current flow to the clockwise terminal 106 and counterclockwise terminal 108. Preferably, the electric eye 96 and relay 110 are provided so that when reflected light is received from the retro-reflective tape 98 such as when the edge is too far inboard, the clockwise terminal 106 is supplied with current. Accordingly, when the edge is too far outboard and reflected light is not present from the retro-reflective tape 98, the eye 96 "senses" the sheet covering the tape 98 and power is supplied to the counterclockwise terminal 108. The inboard limit switch 57*a* is provided to interrupt current flow to the counterclockwise terminal 108 of the motor 50 when actuated by the contact tab 59*a*. Similarly, the outboard limit switch 57*b* is provided to interrupt current flow to the clockwise terminal 106 of the motor 50 when actuated by the contact tab 57*b*. A control circuit for a left hand unit 28 is suitably provided by a similar circuit although it is necessary for motor to be wired with the clockwise and counterclockwise terminals reversed with respect to the relay 110 to steer outwardly when the eye 96 does not "sense" the edge of a sheet 10.

In operation of the preferred embodiment of a steerage unit depicted for steering a sheet 10 as shown in FIG. 1, the steerage units 26 and 28 operate generally as follows. Before a sheet 10 on the conveyor 12 reaches the steerage units, the preferred control circuitry and steerage drive maintains the wheels 32*a* and 32*b* in an orientation for directing an edge of the sheet outwardly since the electric eye 96 receives reflected light from the retro-reflective tape 98 and does not "sense" the sheet. The motor 50 thus is actuated to steer the outwardly until the outboard limit switch 57*b* stops the motor. As a sheet 10 moves on the conveyor 12 into the steerage units 26 and 28, the steerage units receive the leading edge 18 of the sheet 10 between the wheels 32*a* and 32*b* and the spherical balls 44*a* and 44*b* and move with the sheet 10 on the conveyor 12. Because of the slight toe-out between the wheels 32*a* and 32*b*, the cloth between the wheels is caused to become and is maintained in a slightly taut condition.

Depending on the position of the side edges 22 and 24 as they move under the electric eye 96, the units 26 and 28 steer the edges to correct for misalignment. If the edge is in a position which will cover the retro-reflective tape 98 as it passes under the eye 96, the motor 50 will be activated and the wheels 32*a* and 32*b* will be oriented by the steerage drive 48 to direct the sheet between the wheels and at the edge inwardly. Since in the preferred embodiment, the wheels are steered outwardly before the sheet 10 reaches the eye, the system as shown is capable of creating sufficient inboard steerage of the edge to compensate for this initial outboard steerage which occurs between the time the leading edge 18 engaged by a unit and when the leading edge 18 reaches the eye 96. If the sheet is too far inboard and does not cover the retro-reflective tape 98 under the eye 96, the outward steering will continue until the sheet 10 is under the eye and the motor will reverse. Since a single throw, double pole relay 110 is employed, this operation continues even when the edge is properly aligned with the steerage unit alternating to direct the edge momentarily inwardly and outwardly. The edge is thus properly aligned with respect to the eye and any misalignment is corrected.

In the form of the invention as depicted in FIG. 1 having both right and left edge steerage units 26 and 28, the right and left edge steerage units 26 and 28, the right and left side edges 22 and 24 are steered independently. The central area of the sheet thus from is loose and steerage of one side due to irregular tensions in the cloth or minor variations in width will not affect the steerage of the opposite edge. The entire sheet is not pulled laterally except in the case of gross misalignment.

With tandem edge steerage units such as are depicted in FIG. 1, it is preferable for the units to have independent control systems and thus the same control system as shown in FIG. 5 can be used with tandem units. Tandem units both steer the edge and align the edge with for example, a line parallel with the direction of travel. In operation of tandem units, the sheet 10 is first received by one unit which will direct the sheet in relation to one fixed position under the eye 96. When the sheet 10 enters out of alignment this will cause the edge to emerge from the unit at an angle with respect to the direction of movement. When the sheet is received by the second unit, it is steered with respect to a second fixed position under the electric eye by the second unit. Thus, between the two fixed positions, the edge is aligned with a line extending between the two fixed positions and the edge emerges from the second unit in alignment with this line.

The edge steerage apparatus according to the present invention is capable of effectively steering the edge of a moving web as is necessary for various operations. The apparatus is well-suited for steering the edges of deformable webs, i.e., webs which are limp, extensible, or both such as woven and nonwoven fabrics, scrim, mesh, and the like. The preferred embodiment of the edge steerage apparatus according to the present invention depicted in the drawings is capable of lateral motion of a web of up to an inch for every six inches of forward travel of the material. The apparatus is also capable of compensating for the irregular edges in webs such as cut cloth due to irregular tension in the cloth and is capable of steering two side edges independently. In addition, the apparatus is well-suited for the steerage of discrete web units such as units being carried on, for example, a conveyor. On equipment with conveyors with endless belts, the apparatus is easily installed for synchronous operation using a take-off drum which contacts the returning continuous belts of the conveyor.

While preferred embodiments of the present invention have been shown and described in the foregoing detailed description, it will be understood that the invention is capable of numerous modifications without departing from the spirit of the invention as set forth in the appended claims.

What is claimed is:

1. A steerage apparatus for steering an edge of a moving web comprising:

a pair of spaced-apart wheels, one of which is adjacent to the edge, for contacting the moving web at two contact points along a line generally perpendicular to the direction of web movement and for rotating with the movement of the web, said wheels being supported for pivotal movement to change the orientation of rotation of said wheels while generally maintaining the same contact points, said wheels being maintained in an orientation with a slight toe-out in the direction of movement of the web;

web contact means opposing said wheels at said contact points and for contacting the web, said web contact means causing the web to be engaged by both said wheels and said contact means, said web contact means permitting omni-directional, generally planar movement of the web in relation to said web contact means;

edge monitoring means for monitoring the lateral position of the edge of the moving web relative to a selected fixed position as the web passes the selected fixed position; and steering means responsive to the edge monitoring means for orienting the wheels to introduce lateral movement in the moving web between said wheels and at the edge to steer the edge towards the selected fixed position.

2. The apparatus of claim 1 further comprising drive means for driving said wheels at a speed sufficient for a wheel contact surface in contact with the web to move faster than the moving web to compensate for the longer paths along the web which the wheels define when the wheels are not in alignment with the overall direction of web movement.

3. The apparatus of claim 1 wherein said wheels have a resilient contact surface with a rounded cross section in a plane extending through the axis of the wheel.

4. The apparatus of claim 1 wherein said web contact means is a generally spherical ball supported for omni-directional movement for contacting the web and causing the web to be engaged between the wheel and the spherical ball.

5. The apparatus of claim 1 wherein said edge monitoring means comprises an electric eye above said selected fixed position and retro-reflective tape beneath the moving web for detecting the web at the selected fixed position.

6. The apparatus of claim 1 wherein said steering means comprises a reversible synchronous motor with reduction gearing having an output shaft, conversion means for converting the rotational movement of the output shaft into translation movement, and steering linkage for pivoting said wheels in response to the translational movement of said conversion means.

7. A steerage apparatus for steering an edge of a moving web comprising tandem edge steerage units spaced-apart along a path of travel of the edge, each of said units comprising:

a pair of spaced-apart wheels, one of which is adjacent to the edge, for contacting the moving web at two contact points along a line generally perpendicular to the direction of web movement and for rotating with the movement of the web, said wheels being supported for pivotal movement to change the orientation of rotation of said wheels while generally maintaining the same contact points, said wheels being maintained in an orientation with a slight toe-out in the direction of movement of the web;

web contact means opposing said wheels at said contact points and for contacting the web, said web contact means causing the web to be engaged by both said wheels and said contact means, said web contact means permitting generally omni-directional, planar movement of the web in relation to said web contact means;

edge monitoring means for monitoring the lateral position of the edge of the moving web relative to a selected fixed position as the web passes the selected fixed position;

steering means responsive to the edge monitoring means for orienting the wheels to introduce lateral movement in the moving web between said wheels and at the edge to steer the edge towards the selected fixed position.

8. The apparatus of claim 7 further comprising drive means for driving said wheels at a speed sufficient for a wheel contact surface in contact with the web to move faster than the moving web to compensate for the longer paths along the web which the wheels define when the wheels are not in alignment with the overall direction of web movement.

9. The apparatus of claim 7 wherein said wheels have a resilient contact surface with a rounded cross section in a plane extending through the axis of the wheel.

10. The apparatus of claim 7 wherein said web contact means is a generally spherical ball supported for omni-directional movement for contacting the web and causing the web to be engaged between the wheels and the spherical ball.

11. The apparatus of claim 7 wherein said edge monitoring means comprises an electric eye above said selected fixed position and retro-reflective tape beneath the moving web for detecting the web at the selected fixed position.

12. The apparatus of claim 7 wherein said steering means comprises a reversible synchronous motor with reduction gearing having an output shaft, conversion means for converting the rotational movement of the output shaft into translation movement, and steering linkage for pivoting said wheels in response to the translational movement of the conversion means.

13. An edge steerage apparatus for steering right and left edges of a moving web independently comprising a right hand unit and a left hand unit, said right hand unit being for steering the right edge and comprising:

a pair of spaced-apart wheels, one of which is adjacent to the right edge, for contacting the moving web at two contact points along a line generally perpendicular to the direction of web movement and for rotating with the movement of the web, said wheels being supported for pivotal movement to change the orientation of rotation of said wheels while generally maintaining the same contact points, said wheels being maintained in an orientation with a slight toe-out in the direction of movement of the web;

web contact means opposing said wheels at said contact points and for contacting the web, said web contact means causing the web to be engaged by both said wheels and said contact means, said web contact means permitting generally omni-directional, planar movement of the web in relation to said web contact means;

edge monitoring means for monitoring the lateral position of the right edge of the moving web relative to a selected fixed position as the web passes the selected fixed position;

steering means responsive to the edge monitoring means for orienting the wheels to introduce lateral movement in the moving web between said wheels and at the edge to steer the right edge towards the selected fixed position;

said left hand unit being for steering the left edge and comprising:

a pair of spaced-apart wheels, one of which is adjacent to the left edge, for contacting the moving web at two contact points along a line generally perpendicular to the direction of web movement and for rotating with the movement of the web, said wheels being supported for pivotal movement to change the orientation of rotation of said wheels while generally maintaining the same contact points, said wheels being maintained in an orientation with a slight toe-out in the direction of movement of the web;

web contact means opposing said wheels at said contact points and for contacting the web said web contact means causing the web to be engaged by both said wheels and said contact means, said web contact means permitting generally omni-directional, planar movement of the web in relation to said web contact means;

edge monitoring means for monitoring the lateral position of the left edge of the moving web relative to a selected fixed position as the web passes the selected fixed position;

steering means responsive to the edge monitoring means for orienting the wheels to introduce lateral movement in the moving web between said wheels and at the edge to steer the left edge towards the selected fixed position.

14. The apparatus of claim 13 further comprising drive means for driving said wheels at a speed sufficient for a wheel contact surface in contact with the web to move faster than the moving web to compensate for the longer paths along the web which the wheels define when the wheels are not in alignment with the overall direction of web movement.

15. The apparatus of claim 13 wherein said wheels have a resilient contact surface with a rounded cross section in a plane extending through the axis of the wheel.

16. The apparatus of claim 13 wherein said web contact means is a generally spherical ball supported for omni-directional movement for contacting the web and causing the web to be engaged between the wheels and the spherical ball.

17. The apparatus of claim 13 wherein said edge monitoring means comprises an electric eye above said selected fixed position and retro-reflective tape beneath the moving web for detecting the web at the selected fixed position.

18. The apparatus of claim 13 wherein said steering means comprises a reversible synchronous motor with reduction gearing having an output shaft, conversion means for converting the rotational movement of the output shaft into translation movement, and steering linkage for pivoting said wheels in response to the translational movement of the conversion means.

19. Apparatus for the lateral alignment of an edge of a moving web comprising:

web guidance means mounted for movement about a pivotal axis and having rotatable web contact means for rotatably contacting the web along a web contact path to guide the web as the edge passes a selected fixed position, said pivotal axis being laterally disposed with respect to said web edge to intersect said web contact path;

a reversible synchronous motor with gear reduction having a rotating output shaft with a shaft axis generally parallel to the pivotal axis of said web guidance means for being rotatably driven in a clockwise direction and a counterclockwise direction;

a drive crank arm on said output shaft, a driven crank arm connected to said web guidance means of said apparatus for alignment of the edge and a pitman connected between said drive crank arm and said driven crank arm for causing the rotational movement of said output shaft to pivot said web guidance means in a first direction with clockwise rotation of said output shaft and a second direction with counterclockwise rotation of said output shaft;

edge monitoring means for monitoring the lateral position of the edge as it passes the selected fixed position and for actuating the reversible synchronous motor to guide the edge inwardly when said web is outboard of said fixed position and outwardly when edge is inboard of said selected fixed position.

20. The apparatus of claim 19 wherein said monitoring means comprises retro-reflective type electric eye above the fixed position and retro-reflective tape, said monitoring means actuating said motor to guide the edge outwardly when the edge is inboard of the fixed position and light is reflected by said retro-reflective tape and is received by said eye, said monitoring means actuating said motor to guide the edge inwardly when the edge is outboard of the fixed position and the light is not reflected by the retro-reflective tape.

* * * * *